US006945792B2

(12) United States Patent
Hayakawa

(10) Patent No.: US 6,945,792 B2
(45) Date of Patent: Sep. 20, 2005

(54) SOCKET FOR ELECTRICAL PARTS

(75) Inventor: Kenji Hayakawa, Saitama (JP)

(73) Assignee: Enplas Corporation, Saitma (JP)

( * ) Notice: Subject to any disclaimer, the term of this patent is extended or adjusted under 35 U.S.C. 154(b) by 0 days.

(21) Appl. No.: 10/825,521

(22) Filed: Apr. 15, 2004

(65) Prior Publication Data

US 2004/0214456 A1 Oct. 28, 2004

(30) Foreign Application Priority Data

Apr. 25, 2003 (JP) ..... 2003-121054

(51) Int. Cl.[7] ..... H01R 9/09
(52) U.S. Cl. ..... 439/73; 439/266
(58) Field of Search ..... 439/73, 266, 330, 439/70, 71, 331, 152, 159

(56) References Cited

U.S. PATENT DOCUMENTS 5,320,550 A * 6/1994 Uratsuji et al. ..... 439/266
5,374,197 A * 12/1994 Uratsuji ..... 439/71
5,493,237 A * 2/1996 Volz et al. ..... 324/754
6,267,603 B1 * 7/2001 Yamamoto et al. ..... 439/70
6,447,322 B1 * 9/2002 Yan et al. ..... 439/331
6,739,894 B2 * 5/2004 Ogura ..... 439/330
6,776,641 B2 * 8/2004 Hachuda ..... 439/331

FOREIGN PATENT DOCUMENTS

JP 11-297443 10/1999

* cited by examiner

*Primary Examiner*—P. Austin Bradley
*Assistant Examiner*—Phuongchi Nguyen
(74) *Attorney, Agent, or Firm*—Lawrence E. Laubscher, Jr.

(57) ABSTRACT

A socket for electrical parts is provided with a latch operative mechanism that opens and closes latches 3, synchronized with an operation of a socket cover 2. The latch operative mechanism open the latches 3 in a state with the socket cover 2 being pushed to a lowest position, and closes the latches 3 with a rise of the socket cover 2 from the lowest position, and also moves the latches 3 relatively downward with respect to a socket body 1*a*.

10 Claims, 7 Drawing Sheets

SOCKET FOR ELECTRICAL PARTS

BACKGROUND OF THE INVENTION

1. Field of the Invention

The present invention relates to a socket for electrical parts, and more specifically relates to a socket for electrical parts, which includes a latch that opens and closes, synchronized with the operation of a socket cover, and holds the electrical parts on a mounting portion of a socket body by the latch.

2. Description of the Related Art

A socket for electrical parts is used when an electrical part such as an IC package is connected to external equipment such as a measuring or testing unit. The electrical part is connected to the external equipment, in a state of being held on a mounting portion formed in the socket body of the socket for electrical parts. Of the socket for electrical parts, one which is known as an open top type generally comprises a socket body having the mounting portion formed thereon, a socket cover installed vertically movable with respect to the socket body, and a latch which opens and closes, synchronized with the operation of the socket cover. The latch holds the electrical part on the mounting portion in the closed state. A spring is disposed between the latch and the socket body, and the latch is urged by the spring to close. The latch opens when the socket cover is at a lowest position, and closes when the socket cover is at a highest position.

SUMMARY OF THE INVENTION

However, the open top type socket for electrical parts has the following problems. With the recent high integration of IC packages, there is a trend for the number of connection terminals provided in an electrical part to increase. In accordance with this trend, the number of contact pins provided in the socket for electrical parts also increases. However, due to the increase in the number of contact pins, the reaction force caused by the contact pins increases at the time of holding the electrical part on the mounting portion. Therefore, it becomes necessary to employ a spring having a large elastic constant as the spring for urging the latch, and when the electrical part is taken out from the socket, a large force is required for pushing the socket cover against the spring.

It is an object of the present invention to provide a socket for electrical parts, in which the socket cover can be operated with a relatively small force.

A socket for electrical parts according to the present invention comprises: a socket body formed with a mounting portion on which an electrical part is mounted; a socket cover installed vertically movable with respect to the socket body; a latch that opens and closes, synchronized with an operation of the socket cover, that holds the electrical part on the mounting portion in a closed state, and leaves the electrical part open on the mounting portion in an opened state; and a latch operative mechanism that opens and closes the latch. The latch operative mechanism opens the latch in a state with the socket cover pushed to a lowest position, and closes the latch with a rise of the socket cover from the lowest position. Moreover, the latch operative mechanism moves the latch relatively downward with respect to the socket body, in association with the closing operation.

Other objects and features of the present invention will be understood from the following detailed description, and with reference to the appended drawings.

DETAILED DESCRIPTION OF THE INVENTION

Figure 1:
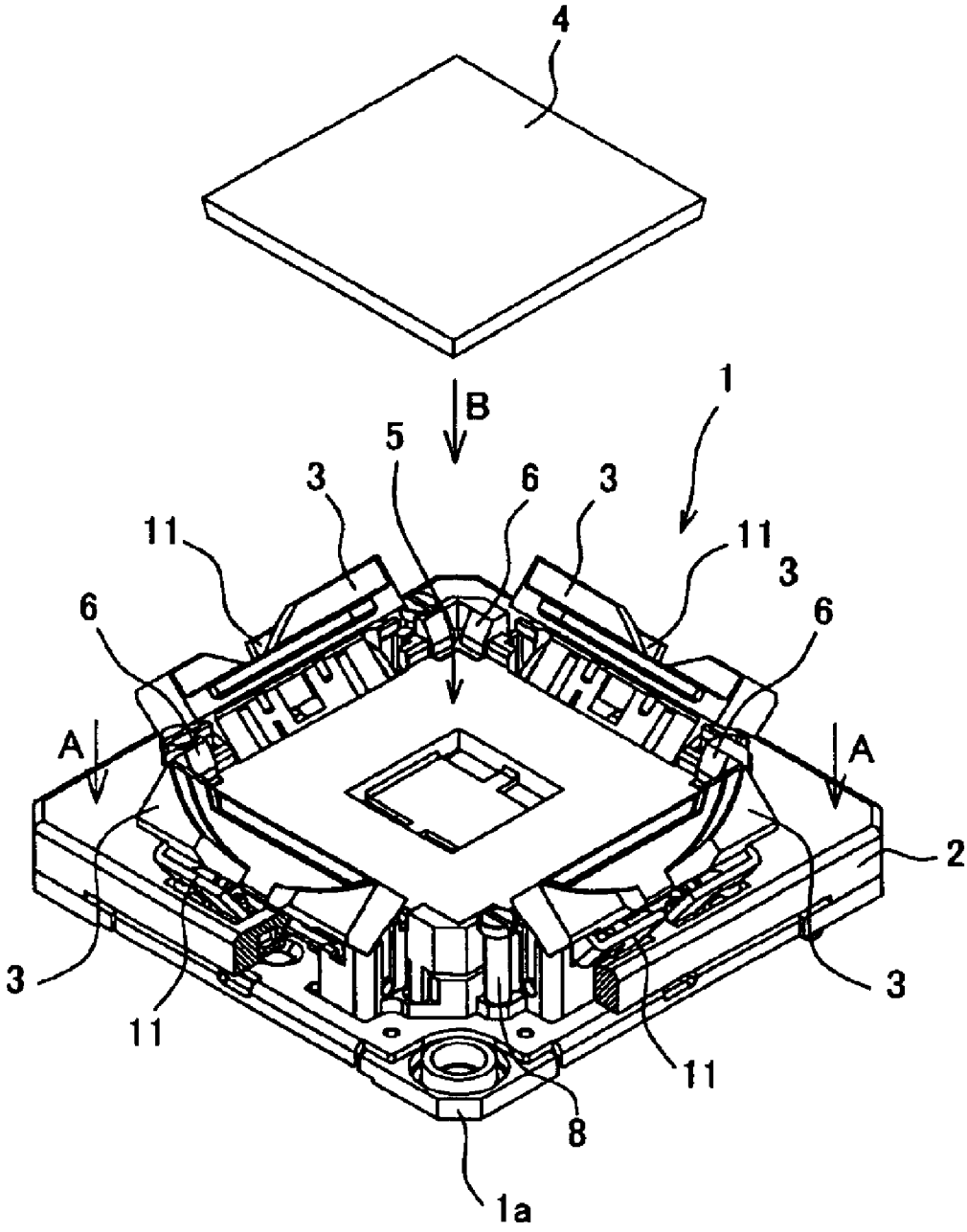
FIG. 1 is a perspective view of a socket for electrical parts according to one embodiment of the present invention, with latches opened.
Figure 2:
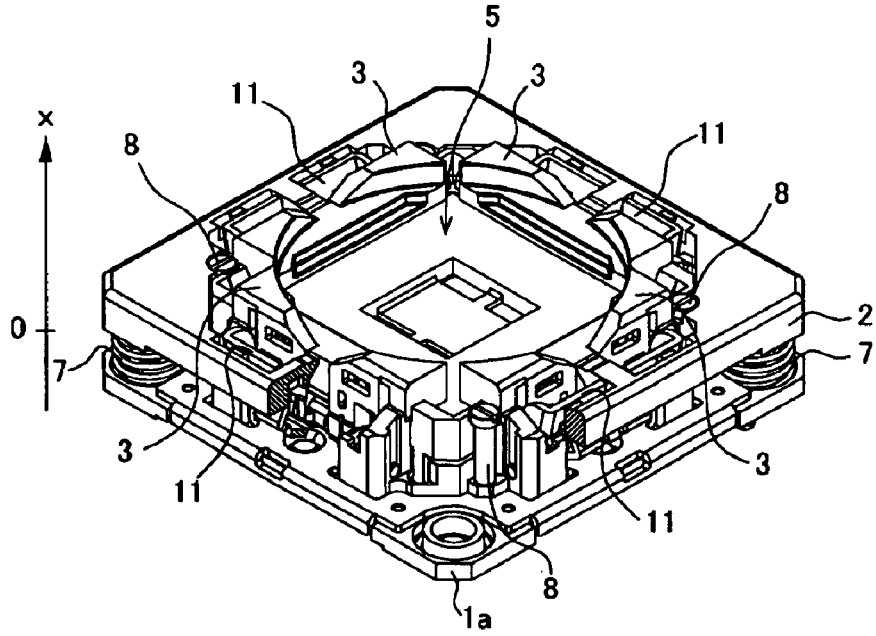
FIG. 2 is a perspective view of the socket for electrical parts, with the latches closed.

FIGS. 1 and 2 are perspective views of a socket 1 for electrical parts (hereinafter referred to as a "socket") according to one embodiment of the present invention. In FIG. 1, a socket cover 2 is at a lowest position, and latches 3 are in an opened state. In FIG. 2, the socket cover 2 is at a highest position, and the latches 3 are in a closed state. In a performance test of an IC package 4 serving as the electrical part shown in FIG. 1, the socket 1 is a jig for detachably holding the IC package 4, to connect it to a measuring device (not shown). The socket 1 includes a socket body 1*a*, the socket cover 2, the latches 3, and a latch operative mechanism.

Figure 3:
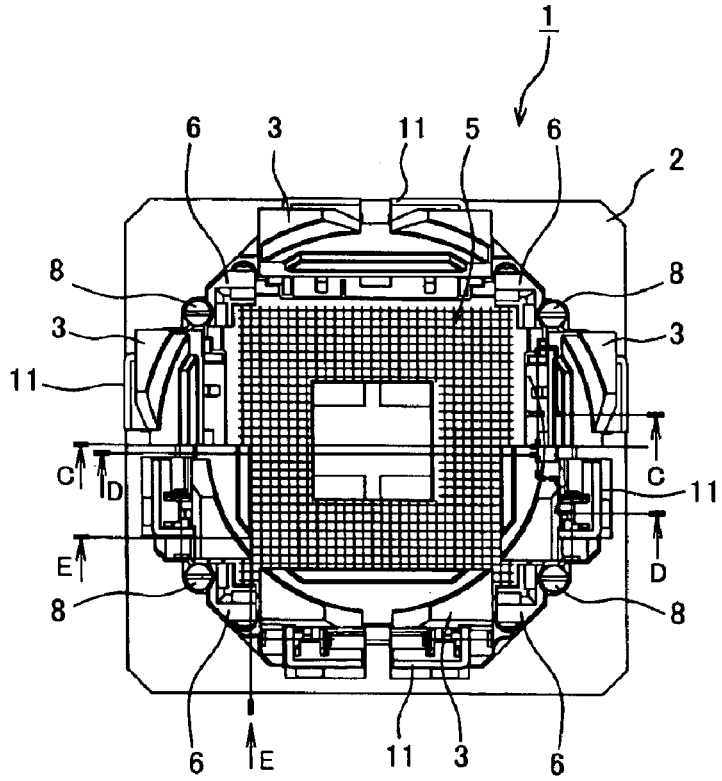
FIG. 3 is a plan view of the socket for electrical parts.

The socket body 1*a* is a base member of the socket 1, and is made of a resin with high strength and excellent thermal resistance. The socket body 1*a* is molded in a substantially rectangular and tabular shape, according to the shape of the IC package 4. In the middle of the socket body 1*a*, a mounting portion 5 is provided (FIG. 3). The mounting portion 5 is a portion where the IC package 4 is mounted at the time of performance testing, and guiding portions 6 in an L shape as seen in plan view are formed at four corners on the periphery thereof. The guiding portions 6 are portions for restricting the sides of the IC package 4 for positioning, when the IC package 4 is held in the socket 1. At the time of positioning, the guiding portions 6 guide the IC package 4 dropped in the direction of B (FIG. 1) to a predetermined position on the mounting portion 5. A plurality of contact pins 15 is arranged in a lattice form in the mounting portion 5.

On the socket body 1*a*, the socket cover 2 is arranged vertically movable with respect to the socket body 1*a*. The socket cover 2 has substantially the same size as the outer dimensions of the socket body 1*a*. The socket cover 2 is an operating member for opening or closing the latches 3, and has a frame shape in which an opening is formed at the center. At four corners of the socket body 1*a*, cover springs 7 are respectively installed between the socket body 1*a* and the socket cover 2. The socket cover 2 is urged upward by the cover springs 7, with respect to the socket body 1*a*. Stopper members 8 are installed inside of the installation positions of the cover springs (FIG. 3). The stopper members 8 are for restricting the upward movement of the socket cover 2. Bases thereof are fixed by screwing to the socket body 1*a*, and head portions are engaged with predetermined portions on the upper face of the socket cover 2, to stop the socket cover 2 at the highest position.

If a downward force as shown by arrow A is applied to the socket cover 2, in a state where the socket cover 2 is at the highest position (FIG. 1), the socket cover 2 can be pushed to the lowest position. When the force applied to the socket cover 2 is released, the socket cover 2 is pushed upward by the cover springs 7. Since the portions on the upper face engage with the heads of the stopper members 8, the socket cover 2 stops at the highest position. The cover springs 7 have a natural length, when the socket cover 2 is at the highest position.

In the socket body 1*a*, the latches 3 are arranged on all sides around the mounting portion 5. Each latch 3 turns about a latch shaft 12 (described later) as an axis, synchronized with the operation of the socket cover 2, and opens and closes in an in and out direction with respect to the mounting portion 5. The latches 3 release the mounting portion 5, in an opened state opened outward. When the latches 3 are in the opened state, the IC package 4 can be mounted on the mounting portion 5 (FIG. 1). On the other hand, the latches 3 hold the IC package 4 on the mounting portion 5, in a closed state closed inward.

The latches 3 are made of a resin with high strength and excellent thermal resistance, and may be an optional shape and number to suit the useage mode of the socket 1. In this embodiment, four latches are provided, and when the respective latches 3 are in the closed state, an opening having a predetermined shape (for example, a perfect circle) is formed above the mounting portion 5, by the inner faces of the respective latches 3. In the performance test such as the burn-in test, a heating unit 17 described later can be fitted via this opening.

In this embodiment, the latches 3 and the socket cover 2 are linked with each other by the latch operative mechanism. The latch operative mechanism according to this embodiment opens the latches 3 outward with respect to the mounting portion 5, with the socket cover 2 being pushed to the lowest position (FIG. 1), and closes the latches 3 inward with respect to the mounting portion 5, with the return of the socket cover 2 from the lowest position to the highest position. Moreover, the latch operative mechanism moves the latches 3 relatively downward, with the return action of the socket cover 2 (FIG. 2).

Figure 4:
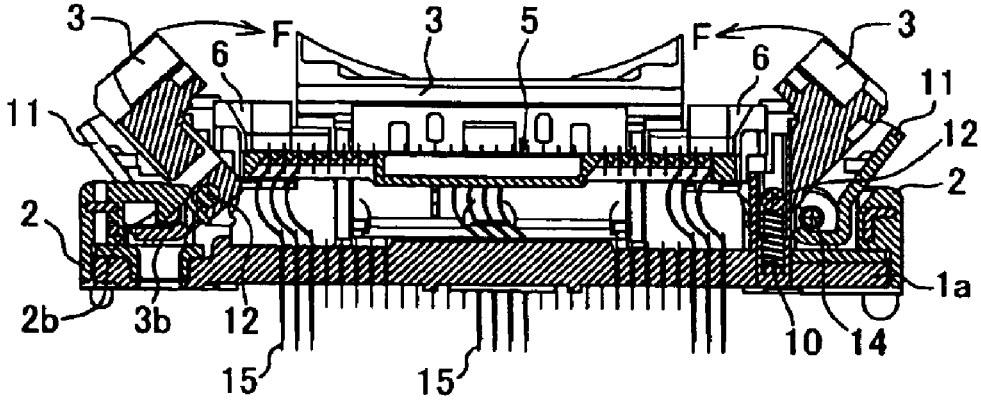
FIG. 4 is a sectional view along the line C—C of the socket for electrical parts shown in FIG. 3.
Figure 5:
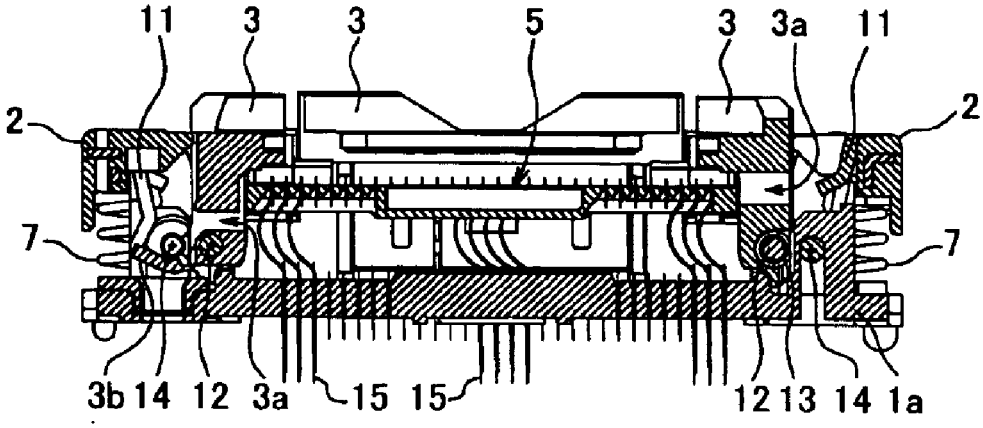
FIG. 5 is a sectional view along the line D—D of the socket for electrical parts shown in FIG. 3.

FIG. 4 is a sectional view along the line C—C of the socket 1 shown in FIG. 1, when the latches 3 are in the opened state. FIG. 5 is a sectional view along the line D—D of the socket 1 shown in FIG. 1, when the latches 3 are in the closed state. The latch operative mechanism according to this embodiment comprises a shaft spring (corresponding to an "urging member") 10, a lever member 11, a latch shaft (corresponding to a "first shaft member") 12, and a lever shaft (corresponding to a "second shaft member") 14. The latch shaft 12 is arranged outside of the mounting portion 5, and the latch 3 is pivotally supported by the latch shaft 12, so as to be able to rotate about the latch shaft 12. In other words, the latch shaft 12 rotates the latch 3 in the opened state in a direction of the arrow F (FIG. 4), to close the latch 3 inwards (FIG. 5). The latch shaft 12 also serves as a support member for supporting the latch 3 vertically movable with respect to the socket body 1*a*.

The shaft spring 10 is installed between the socket body 1*a* and the latch shaft 12. The latch shaft 12 is fitted to the socket body 1*a* in a state of being urged upward by the shaft spring 10. A return spring 13 is also fitted to the latch shaft 12 for urging the latch 3 in the closed state outward (FIG. 5). The return spring 13 urges the latch 3 to a neutral position set between the closed position and the opened position. Therefore, the latch 3 in the closed state is urged upward by the shaft spring 10, and also urged outward by the return spring 13. In this embodiment, a torsion spring is employed as the return spring 13.

The lever member 11 is arranged outside of the latch 3 in the socket body 1*a*. The lever member 11 serves as an operating member that moves the latch 3 downward when the socket cover 2 returns from the lowest position to the highest position. In this embodiment, the lever member 11 is made of a metal having high rigidity, and is formed substantially in a U shape as seen in plan view (FIG. 3), and the section thereof is substantially in an L shape as shown in FIGS. 4 to 6.

Figure 6:
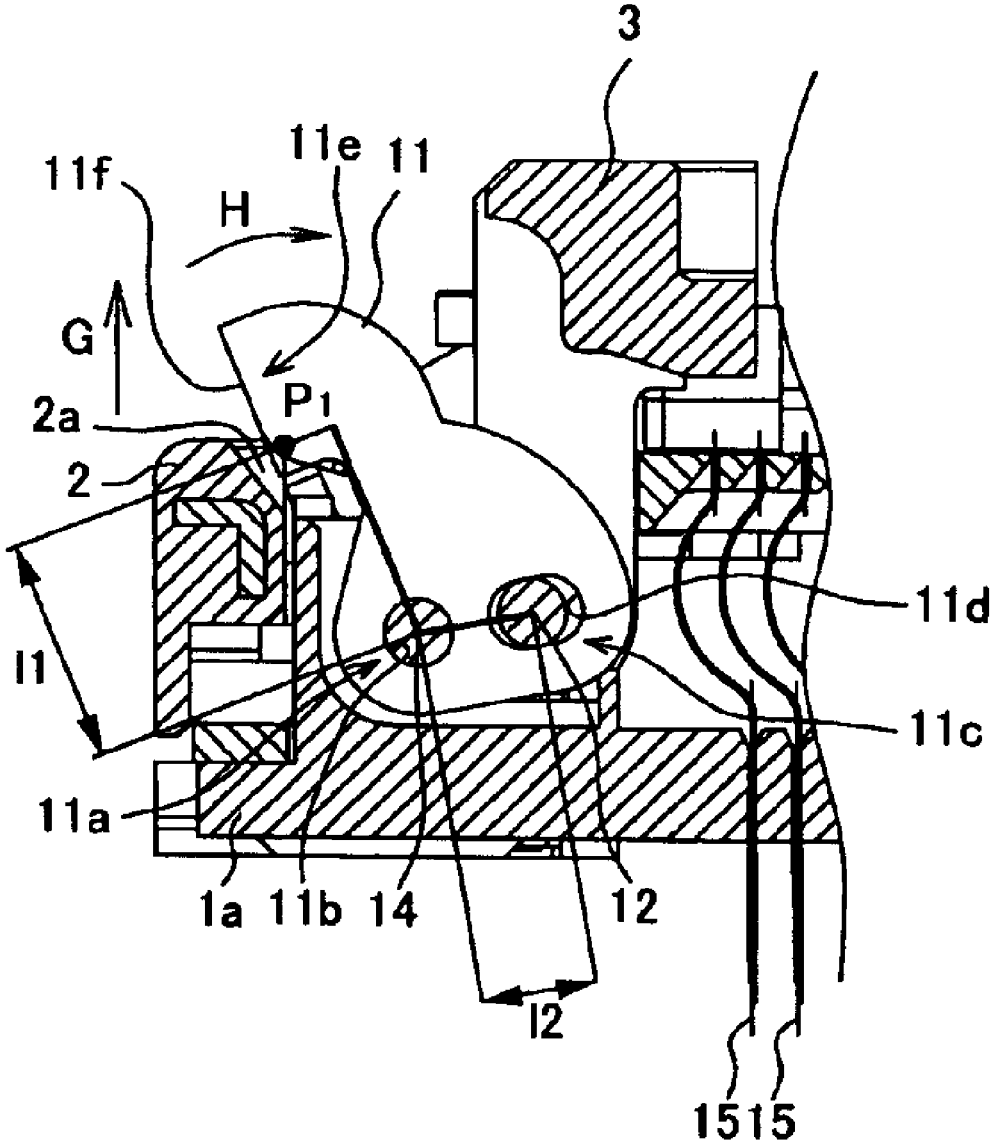
FIG. 6 is an enlarged view of a section along the line E—E of the socket for electrical parts shown in FIG. 3.

FIG. 6 is an enlarged view of a section along the line E—E of the socket 1 shown in FIG. 3. The lever shaft 14 is installed outside of the latch shaft 12, and fixed with respect to the socket body 1*a*. In the lever member 11, there are formed a first hole 11*b* at a portion 11*a* corresponding to a corner of the L shape, and a second hole 11*d* at a portion 11*c* corresponding to one side of the L shape. The lever member 11 is pivotally supported by the lever shaft 14, with the lever shaft 14 inserted in the first hole 11*b*, and can rotate about the lever shaft 14. The second hole 11*d* is formed in an elliptic shape longer in a direction perpendicular to a circumferential direction of the first hole 11*b*, and the latch shaft 12 is inserted in the second hole 11*d*. The lever member 11 is formed such that a backside 11*f* is flat at a portion 11*e* corresponding to the other side of the L shape. The backside 11*f* abuts against an upper end 2*a* of the inner face of the socket cover 2, at the time of return of the socket cover 2, so as to be a sliding face, which receives a force from the socket cover, and is inclined with respect to the moving direction of the socket cover 2. Therefore, the lever member 11 receives a force from the socket cover 2 via the backside 11*f*, when the socket cover 2 is pushed upward by the cover spring 7, to rotate in a direction of the arrow H about the lever shaft 14, so as to push the latch shaft 12 and the latch 3 downward against the shaft spring 10.

That is to say, at the time of return of the socket cover 2, a portion of the backside 11*f*, against which the upper end 2*a* of the inner face of the socket cover 2 abuts, becomes a point of pressure $P_1$. The point of pressure $P_1$ rubs upward against the backside 11*f*, with a rise of the socket cover 2. The lever member 11 rotates about the lever shaft 14, to push downward the latch shaft 12 inserted in the second hole 11*d*.

Here, the size of the force by which the lever member 11 pushes the latch shaft 12 downward when the socket cover 2 returns from the lowest position to the highest position will be described, with reference to FIGS. 2 and 6.

In FIG. 2, the X axis is taken as the upward direction in which the cover spring 7 extends, with the point at which the socket cover 2 is at the highest position (the cover spring 7 has the natural length) designated as the origin. A restoring force $F_0$ generated by the cover spring 7 when the socket cover 2 is pushed to the lowest position by applying a downward force shown by the arrow A (FIG. 1) to the socket cover 2 is given by the following equation, wherein k denotes the elastic constant of the cover spring 7:

$$F_0=-kx \quad (1).$$

According to this equation, the restoring force $F_0$ becomes the largest when the socket cover 2 is in the state of being pushed to the lowest position. The restoring force $F_0$ decreases as the force applied to the socket cover 2 is released to push the socket cover 2 upward, and the cover spring 7 resumes the natural length. Therefore, the force (that is, the restoring force $F_0$) applied upward to the socket cover 2 by the cover spring 7 becomes the largest when the socket cover 2 is at the lowest position, and decreases as the socket cover 2 approaches the highest position.

On the other hand, in FIG. 6, the point of pressure $P_1$, at which the lever member 11 receives a force from the socket cover 2, moves away from the lever shaft 14, with a rise of the socket cover 2. The lever shaft 14 becomes a fulcrum at the time of rotation of the lever member 11. Therefore, as the point of pressure $P_1$ moves away from the lever shaft 14, a leverage ($=l_1/l_2$) of the lever member 11 increases, so that a larger moment than that of a certain leverage acts on the latch shaft 12. In other words, the leverage of the lever member 11 and the restoring force $F_0$ of the cover spring 7 are inversely proportional to each other. Immediately after the socket cover 2 starts the return action, the leverage is small, but the restoring force $F_0$ is large. As the socket cover 2 goes up, and the displacement of the cover spring 7 decreases, the restoring force $F_0$ decreases, but the leverage increases. As a result, the latches 3 can be moved downward, while keeping the force applied to the latch shaft 12 by the lever member 11 large at all times.

Figure 7:
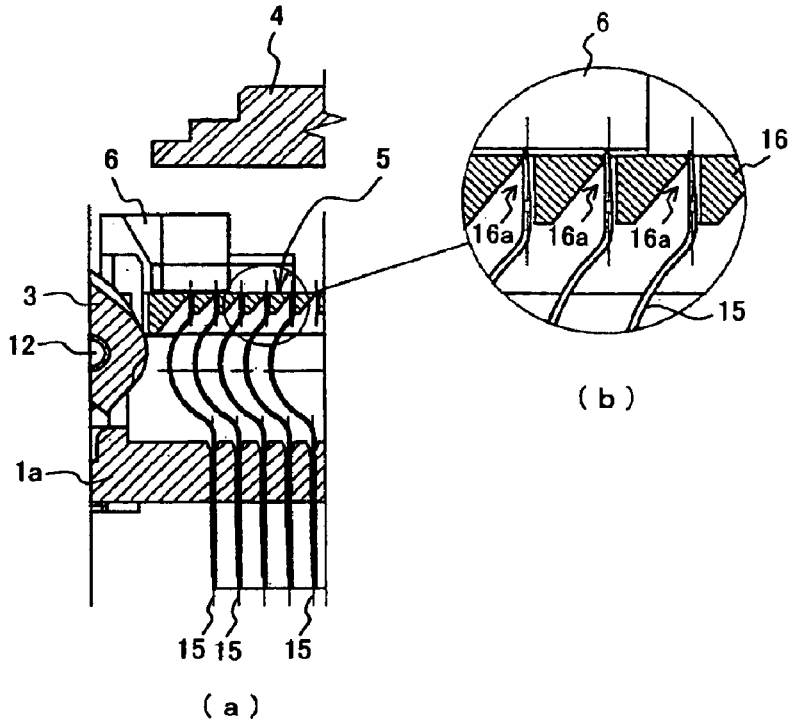
FIG. 7A is a sectional view of the socket for electrical parts shown in FIG. 4.
FIG. 7B is a partially enlarged view of the section.
Figure 8:
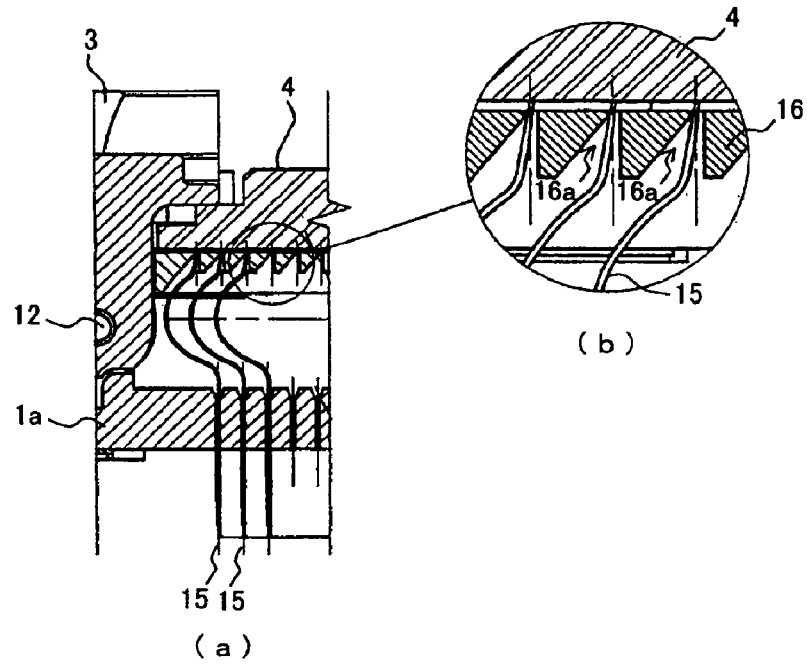
FIG. 8A is a sectional view of the socket for electrical parts shown in FIG. 5.
FIG. 8B is a partially enlarged view of the section.

FIG. 7 is a partially enlarged view of the socket 1 shown in FIG. 4, wherein an IC package 4 is not mounted on the mounting portion 5, and a load is not applied to the contact pins 15 of the socket 1. FIG. 8 is a partially enlarged view of the socket 1 shown in FIG. 5, wherein an IC package 4 is mounted on the mounting portion 5, and a load is applied to the contact pins 15, so that the contact pins 15 are connected with the connection terminals of the IC package 4. The contact pins 15 are made by press-working into plate form a material having excellent electroconductivity so as to give resilience.

Each contact pin 15 is formed such that the lower part thereof is in a linear shape, and the upper part is curved. The lower part of the contact pin 15 is passed through the socket body 1*a*, and fixed to the socket body 1*a*. The point of the upper part of the contact pin 15 is fitted into a hole 16*a* formed in a floating plate 16. The floating plate 16 serves as the mounting portion 5, and is arranged above the socket body 1*a*, and resiliently supported by the contact pins 15 with respect to the socket body 1*a*.

When the latches 3 are in the opened state, and the floating plate 16 is in a free state, a substantial load is not applied to the contact pins 15. When an IC package 4 is mounted on the mounting portion 5 and the socket cover 2 is returned to the highest position, the latches 3 are closed to press the periphery of the IC package 4, and the floating plate 16 is in a depressed state. The contact pins 15 are connected to the connection terminals of the IC package 4 in this state.

A performance test of the IC package 4 performed by using the socket 1 constructed as described above will be described below.

At first, a downward force is applied to the socket cover 2 to push the socket cover 2 to the lowest position, to open the latches 3 (FIG. 1). In the latch 3, a guard 3*b* is formed at the lower end on the back. A protruding portion 2*b* extending downward from the top of the socket cover 2 engages with the guard 3*b*, to maintain the opened state of the latch 3. An IC package 4 is then dropped in the direction of the arrow B, to mount it on the mounting portion 5. The sides of the IC package 4 are restricted by the guiding portions 6 provided at the four corners of the mounting portion 5, so that the IC package 4 is guided to a predetermined position on the mounting portion 5, and positioned.

When the force for pushing the socket cover 2 downward is released so that the socket cover 2 returns to the highest position, the latches 3 are closed by the latch operative mechanisms, and pushed downward (FIG. 2). Therefore, the periphery of the IC package 4 on the mounting portion 5 is pressed by the latches 3, to secure the IC package 4 on the mounting portion 5. The connection terminals provided in the IC package 4 are connected to the contact pins 15 provided on the mounting portion 5, so that the IC package 4 is connected to the measuring device.

Figure 9:
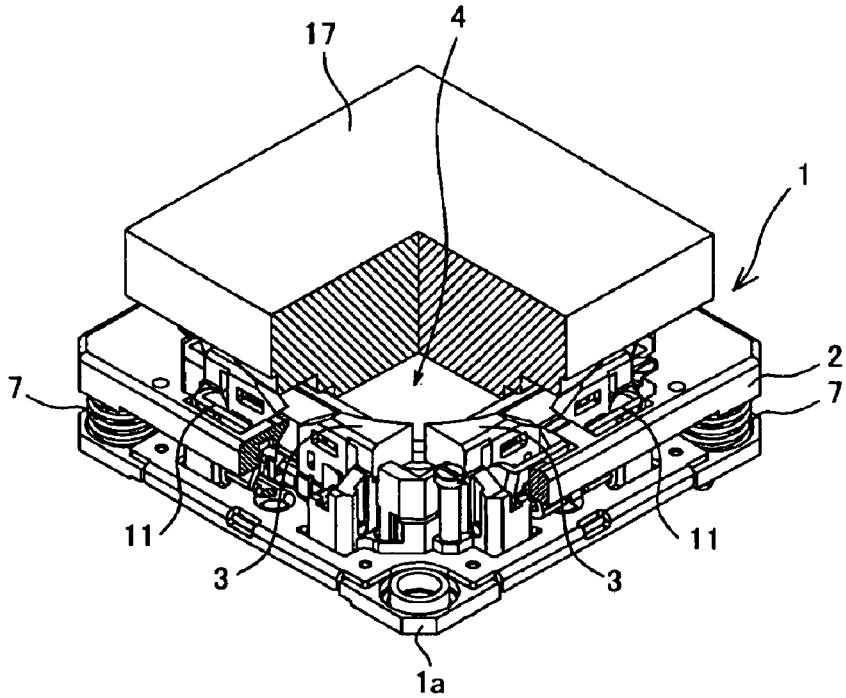
FIG. 9 is a perspective view for explaining the use of the socket for electrical parts in a burn-in test.

A heating unit 17 is fitted into an opening formed by the latches 3 in the closed state (FIG. 9). The heating unit 17 is for heating the IC package 4 on the mounting portion 5 for the burn-in test, and piping for circulating high-temperature gas or liquid is provided therein. The bottom of the heating unit 17 has a shape matched with the opening formed by the latches 3. As a result, the heating unit 17 can be brought into contact with the IC package 4 on the mounting portion 5, to heat the IC package 4. At the center of the latch 3, a vent hole 3*a* for releasing heat generated by the heating unit 17 and heat generated by the IC package 4 to the outside is formed (FIG. 5).

In this embodiment, the latches 3 are corresponding to a hold means of the present invention, and the shaft spring 10, the lever member 11, the latch shaft 12, and the lever shaft 14 constitute a drive means of the present invention.

According to this embodiment, the following effects can be obtained.

Firstly, the latch operative mechanism for synchronizing the socket cover 2 and the latch 3 is provided, so that when the socket cover 2 returns from the lowest position to the highest position, the latch 3 is closed and moved downward by the latch operative mechanism. As a result, the IC package 4 serving as an electrical part on the mounting portion 5 can be pressed and held with respect to the mounting portion 5, thereby enabling reliable connection between the connection terminals of the IC package 4 and the contact pins 15.

Secondly, the latch 3 is supported by the latch shaft 12, and the latch shaft 12 is moved vertically by the lever member 11 to move the latch 3 downward. As a result, the latch operative mechanism is formed by a small number of parts, thereby enabling a reduction in the installation space.

Thirdly, the shaft spring 10 is installed between the latch shaft 12 and the socket body 1*a*, so that the latch shaft 12 is urged upward by the shaft spring 10. As a result, the upward return action of the latches 3 can be performed by the shaft spring 10, thereby enabling further space saving.

Fourthly, since the lever member 11 is positioned outside of the latches 3 in the socket body 1*a*, the latch operative mechanism can be assembled without interfering with the components on the socket body 1*a* side, thereby alleviating the restriction on the layout of the latches 3. As a result, the latches 3 can be provided on all sides around the mounting portion 5.

Fifthly, the point of pressure $P_1$, at which the lever member 11 receives a force from the socket cover 2 at the time of return of the socket cover 2, moves away from the fulcrum of the lever member 11 (that is, the lever shaft 14), with a rise of the socket cover 2. As a result, a large moment can be made to act on the latches 3 at all times. Therefore, the latches 3 can be pushed downward with a large force by the lever member 11, a cover spring 7 having a small elastic constant can be employed in a socket 1 provided with many contact pins 15, and the socket cover 2 can be pushed downward with a small force.

Sixthly, since the latches 3 and the latch operative mechanisms are provided on all sides around the mounting portion 5, so as to surround the mounting portion 5, the periphery of the IC package 4 can be pressed and reliably held on the mounting portion 5.

Figure 10:
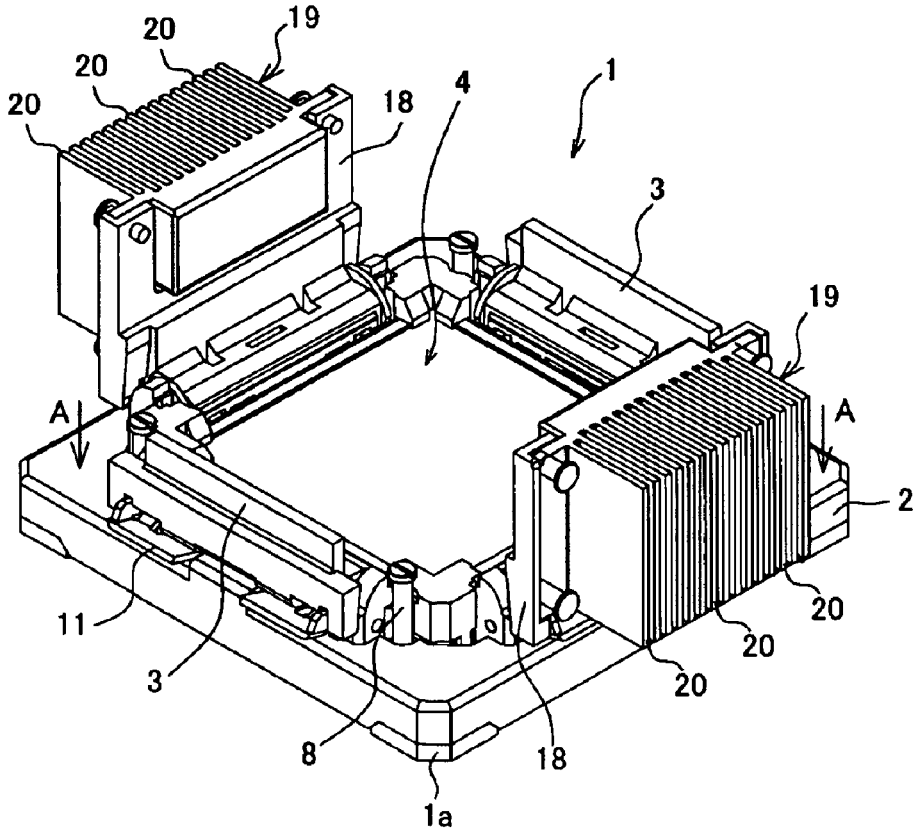
FIG. 10 is a perspective view of a socket for electrical parts according to another embodiment of the present invention, with latches opened.
Figure 11:
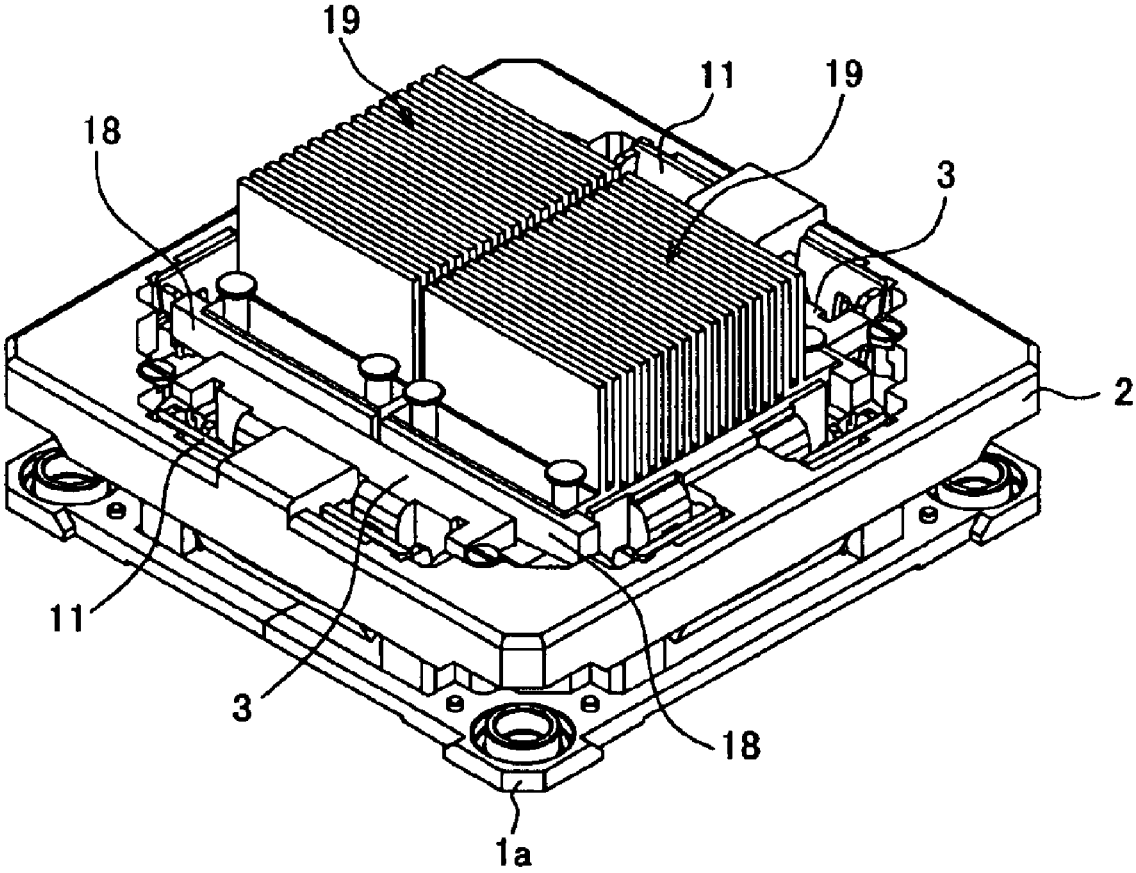
FIG. 11 is a perspective view of the socket for electrical parts, with the latches closed.

FIG. 10 is a perspective view of a socket 1 according to another embodiment of the present invention. In this embodiment, the socket 1 comprises latches 3 and arms 18, formed so as to be able to close or open, synchronized with the operation of a socket cover 2. The arms 18 also serve as latches 3. Heat sinks 19 are attached to the arms 18. The heat sinks 19 abut against an IC package 4 on a mounting portion 5, when the arms 18 are in a closed state, to become a radiator for radiating heat generated by the IC package 4 to the open air, and a plurality of cooling fins 20 are formed therein. The heat sinks 19 are made by aluminum machining or die-casting, to achieve a low weight overall. A latch operative mechanism provided for the latch 3 and the arm 18 is similar to that of the former embodiment. That is to say, the latch operative mechanism comprises a shaft spring 10 as an urging member, a lever member 11, a latch shaft 12 as a first shaft member, and a lever shaft 14 as a second shaft member, and closes the latch 3 and the arm 18 with a rise of the socket cover 2 from the lowest position, and moves the latch 3 and the arm 18 downward.

A case where the latch 3 and the latch operative mechanism are provided on all sides of the mounting portion 5 has been described above, but the layout of the latches 3 and the like is not limited thereto, and may be optionally arranged to suit the shape of the mounting portion 5. When the mounting portion 5 is formed in an octagon (in this case, corresponding to an octagonal IC package 4), eight latches 3 and eight latch operative mechanisms can be provided around the mounting portion 5.

Specific preferred embodiments of the present invention have been described above, but the scope of the present invention is not limited thereto.

What is claimed is:

1. A socket for electrical parts comprising:

a socket body formed with a mounting portion on which an electrical part is mounted;

a socket cover installed vertically movable with respect to the socket body;

a latch that opens and closes, synchronized with an operation of the socket cover, that holds the electrical part on the mounting portion in a closed state, and leaves the electrical part open on the mounting portion in an opened state; and a latch operative mechanism that opens and closes the latch, that opens the latch in a state with the socket cover pushed to a lowest position, and closes the latch with a rise of the socket cover from the lowest position, and moves the latch relatively downward in association with the closing operation of the latch, wherein the latch and the latch operative mechanism are provided in the socket body on all sides of the mounting portion, so as to surround the mounting portion.

2. A socket for electrical parts according to claim 1, wherein the latch operative mechanism comprises: a support member that supports the latch vertically movable with respect to the socket body, and a lever member that operates the latch when the socket cover is raised from the lowest position.

3. A socket for electrical parts according to claim 2, further comprising an urging member which urges the support member upwards.

4. A socket for electrical parts according to claim 2, wherein the lever member is positioned outside of the latch in the socket body.

5. A socket for electrical parts according to claim 4, wherein a point of pressure at which the lever member receives a force from the socket cover, moves away from a fulcrum of the lever member with a rise of the socket cover.

6. A socket for electrical parts, comprising a socket body formed with a mounting portion on which an electrical part is mounted;

a socket cover installed so as to surround the mounting portion and be able to move between a highest position set at a relatively upper position with respect to the socket body, and a lowest position set downward from the highest position;

a latch that opens and closes, synchronized with an operation of the socket cover, that holds the electrical part on the mounting portion in a closed state, and leaves the electrical part open on the mounting portion in an opened state; and a latch operative mechanism that opens and closes the latch corresponding to a position of the socket cover, the latch operative mechanism including a first shaft member that supports the latch vertically movable with respect to the socket body and a lever member disposed between the socket cover and the support member that moves the first shaft member downward in association with the return of the socket cover from the lowest position to the highest position, the latch rotating about a central axis of the first shaft member to open and close;

and the latch operative mechanism opens the latch when the socket cover is at the lowest position, and positions the latch at an opening position, and closes the latch when the socket cover is at the highest position, and positions the latch at a holding position set relatively downward from the opening position; and wherein the latch operative mechanism further comprises a second shaft member with a position thereof with respect to the socket body being fixed, and the lever member has a portion formed with a first hole, and a portion formed with a second hole of an elliptic shape longer in a direction perpendicular to a circumferential direction of the first hole, and the first shaft member is inserted in the second hole, and the second shaft member is inserted in the first hole.

7. A socket for electrical parts according to claim 6, wherein the latch operative mechanism further comprises an urging member that urges the latch upward with respect to the socket body.

8. A socket for electrical parts according to claim 6, wherein the second shaft member is located outside of the first shaft member, with respect to an in and out direction of the socket cover determined as a direction perpendicular to a moving direction of the socket cover.

9. A socket for electrical parts according to claim 8, wherein the lever member is driven by the socket cover at the time of return of the socket cover, to displace the second hole in a rotation direction about the first hole.

10. A socket for electrical parts according to claim 9, wherein a point of pressure at which the lever member receives a force from the socket cover at the time of return of the socket cover, moves away from the first hole with the return of the socket cover.

* * * * *